United States Patent [19]

Braker et al.

[11] Patent Number: 5,035,209

[45] Date of Patent: Jul. 30, 1991

[54] RETENTION SHELF FOR AN ENGINE

[75] Inventors: Brent L. Braker, Morton; J. Barry Heisey, Chillicothe, both of Ill.

[73] Assignee: Caterpillar Inc., Peoria, Ill.

[21] Appl. No.: 586,345

[22] Filed: Sep. 21, 1990

[51] Int. Cl.[5] ..... F01L 1/14

[52] U.S. Cl. ..... 123/90.61; 123/195 R

[58] Field of Search ..... 123/195 R, 198 R, 198 E, 123/198 D, 90.39, 90.61

[56] References Cited

U.S. PATENT DOCUMENTS

| | | | |
|---|---|---|---|
| 3,195,527 | 7/1965 | Eaton | 123/90.61 |
| 3,963,280 | 6/1976 | Irving | 308/5 V |
| 4,850,315 | 7/1989 | Mallas | 123/90.61 |
| 4,856,467 | 8/1989 | Kronich | 123/90.43 |
| 4,864,983 | 9/1989 | Breitbarth | 123/90.61 |

*Primary Examiner*—Noah P. Kamen

*Attorney, Agent, or Firm*—Larry G. Cain

[57] ABSTRACT

The design and construction of past pushrod retainers have required complex components, sliding relationships and additional assembly time and expense. The present invention overcomes these problems by using a retention shelf attached to a cylinder block. Thus, the components are simple to install, inexpensive to manufacture and do not increase assembly time since there is no adjustment necessary when using the device. The present retention shelf assemblies provide a device which prevents extensive damage to the engine caused by a large separation between the cupped end of the pushrod and the first end of the rocker arm which allows the pushrod to fall into other components, resulting in malfunction of the engine. The device is preassembled to the cylinder block and requires no additional assembly time or alignment when assembling the engine. The device is inexpensive to manufacture and prevents the pushrod from causing damage to the engine should the first end of the rocker arm not be moved to the second operating position causing the pushrod (94) to become free or disconnected.

19 Claims, 4 Drawing Sheets

RETENTION SHELF FOR AN ENGINE

TECHNICAL FIELD

This invention relates generally to an engine or compressor and more particularly to a retention shelf for preventing a pushrod, which may have become detached during operation of the engine, from damaging other components of the engine or compressor.

BACKGROUND ART

Many engines and compressors use a camshaft, a pushrod and a rocker arm mechanism to functionally operate valves and/or unit fuel injectors. Typically, such components operate as a tuned combination and the engine or compressor operates smoothly. However, under certain conditions such as engine overspeed, injector seizure or valve spring breakage, the upper end of the pushrod can lose contact with the rocker arm and fall to one side. When this happens, the rotating camshaft moves the pushrod into contact with nearby components of the engine with sufficient force to seriously damage the components of the engine. Another mode of damage occurs when the pushrod falls into rotating components such as the camshaft. If misalignment of the pushrod and the cam follower occurs, the rocker arm will no longer move the valves or the injector, thus malfunction of the engine will occur.

An example of a device to prevent this from occurring is disclosed in U.S. Pat. No. 3,963,280 issued to Phillip E. Irving on June 15, 1976. In such system, the pushrod guide or locator is attached to a stud on a cylinder head. The guide is made up of two planar portions having an angular and planar relationship to one another. This relationship is required to appropriately position the mounting to the engine with respect to the reciprocating movement of the pushrod. The guide has a slot therein in which a bushing having a peripheral groove is positioned. The bushing has a bore therein through which the pushrod passes. Angular and reciprocal movement of the pushrod is compensated for by the bushing's peripheral groove moving in the slot. A pushrod guide of this design requires a stamped or formed plate and a machined bushing to functionally guide and locate the pushrod. The movement of the bushing with respect to the plate will cause wear and eventual malfunctioning of the engine or compressor. Furthermore, the assembly of the plate to the head requires the plate to be attached and properly aligned with respect to the pushrod location. The assembly of the bushing, pushrod and plate during the assembly of the engine increases the complexity of the alignment and assembly technique thus adding time and cost with the end result being reduced profitability.

The present invention is directed to overcome one or more of the problems set forth above.

DISCLOSURE OF THE INVENTION

In one aspect of the present invention, an engine having a retention shelf is comprised of a cylinder block having a through bore and a plurality of openings therein, the openings being substantially in line and intersecting with the through bore therein; a rocker arm pivotally mounted to the cylinder block and having a first end, the first end being movable between a first and second operating position; means for biasing the first end of the rocker arm from the first operating position to the second operating position; a pushrod being normally in contact with the first end of the rocker arm; means for reciprocating the pushrod and moving the first end of the rocker arm from the second operating position to the first operating position; and means for preventing the pushrod from potentially damaging the engine should the biasing means fail to move the first end of the rocker arm to the second operating position, the preventing means includes at least one shelf assembly at least partially filling the openings and being attached to the cylinder block.

In another aspect of the present invention, a retention shelf is adapted for use in an engine, the engine includes; a cylinder block having a through bore and a plurality of openings therein, the openings being substantially in line and intersecting with the through bore therein; a rocker arm pivotally mounted to the cylinder block and having a first end, the first end being movable between a first and second operating position; means for biasing the first end of the rocker arm from the first operating position to the second operating position; a pushrod being normally in contact with the first end of the rocker arm; means for reciprocating the pushrod and moving the first end of the rocker arm from the second operating position to the first operating position; and means for preventing the pushrod from potentially damaging the engine should the biasing means fail to move the first end of the rocker arm to the second operating position, when installed in the engine the preventing means including at least one retention shelf assembly at least partially filling the openings and being attached to the cylinder block.

BEST MODE FOR CARRYING OUT THE INVENTION

Figure 1:
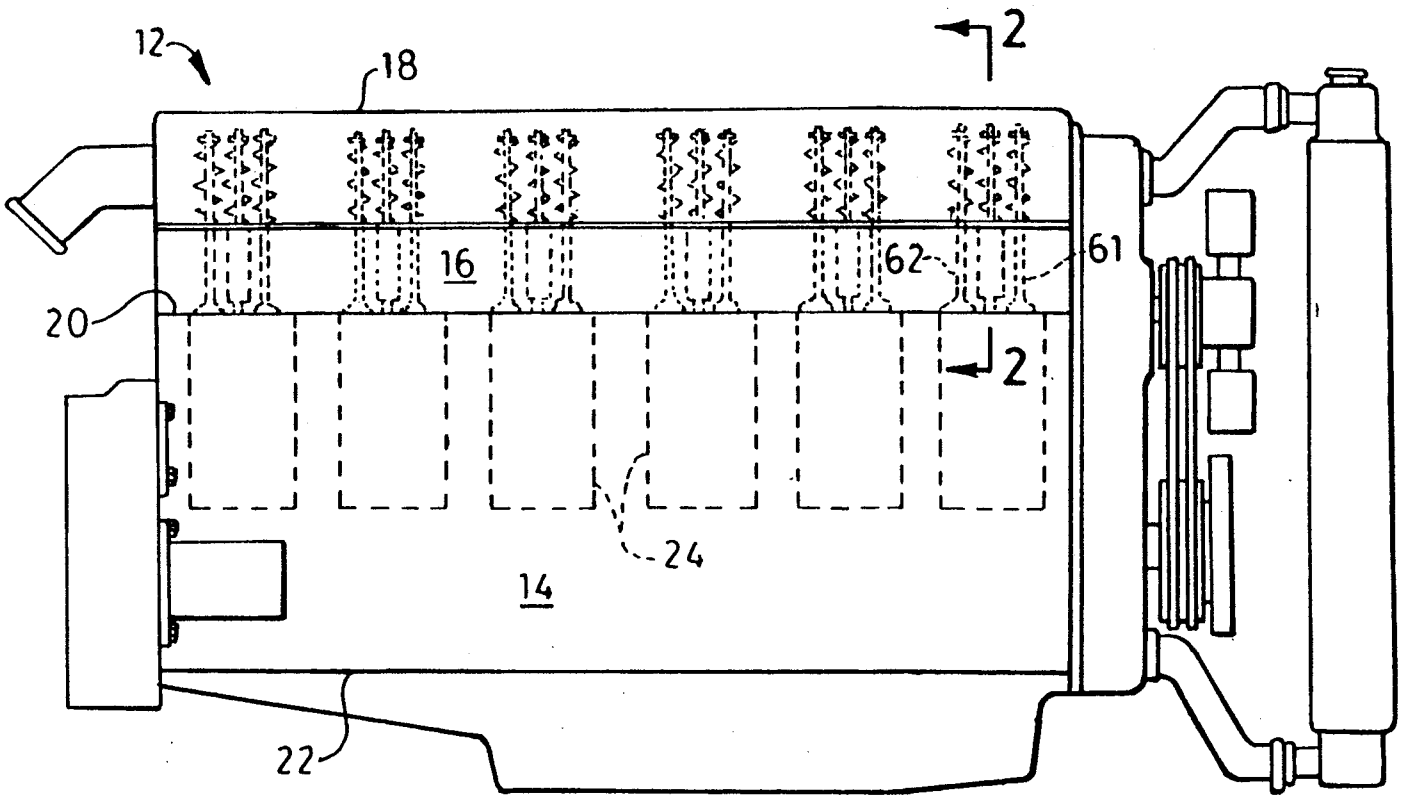
FIG. 1 is a side view of an engine disclosing the retention shelf of the present invention.

Referring to the drawings, a multi-cylinder 20 engine 12 is shown. The engine 12 includes a cylinder block 14, a cylinder head 16 attached to the block 14 and a valve cover 18 attached to the head 16. These components are of a generally conventional design.

The block 14 includes a top mounting surface 20, a bottom mounting surface 22, a plurality of equally spaced in line cylinder bores 24 perpendicularly positioned relative to the top mounting surface 20 and a longitudinally disposed through bore 26 spaced from the centers of the plurality of cylinder bores 24 and intermediate the top and bottom mounting surfaces 20,22. The block 14 defines a plurality of openings 28 extending at least partially between the top and bottom mounting surfaces 20,22, spaced from the in-line cylinder bores 24 and substantially in-line with the through bore 26. A plurality of mounting surfaces 30 extend from the block 14 and have a portion of the plurality of the mounting surfaces partially blocking the openings 28 and extend therebetween. The plurality of mounting surfaces 30 are elevationally positioned intermediate the top mounting surface 20 and the through bore 26. Functionally, the plurality of mounting surfaces 30 must be positioned above the through bore 26. A plurality of threaded holes 32 are positioned in the plurality of mounting surfaces 30 and extend into the block 14.

Figure 2:
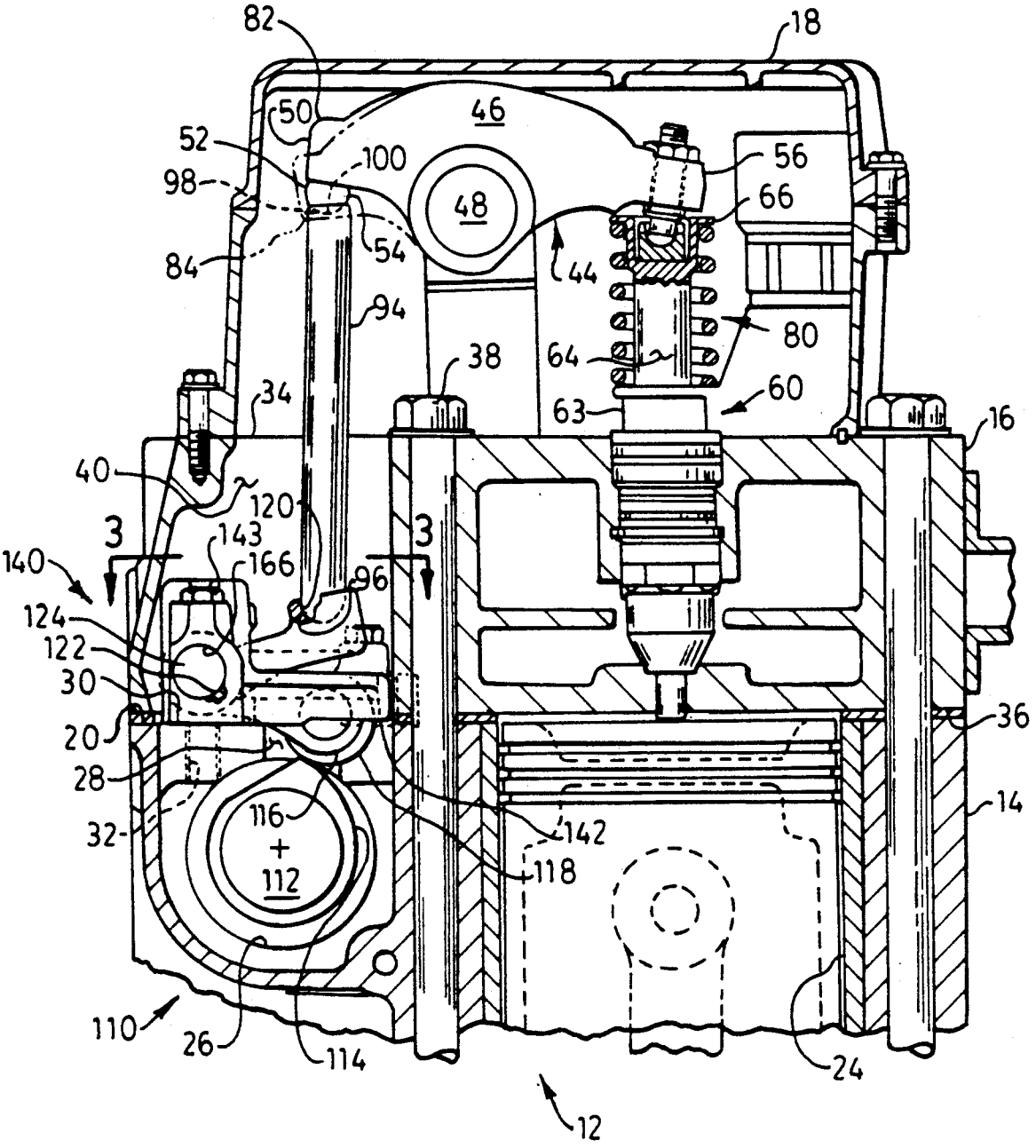
FIG. 2 is an enlarged sectional view of the engine and the retention shelf taken along line 2—2 of FIG. 1.
Figure 3:
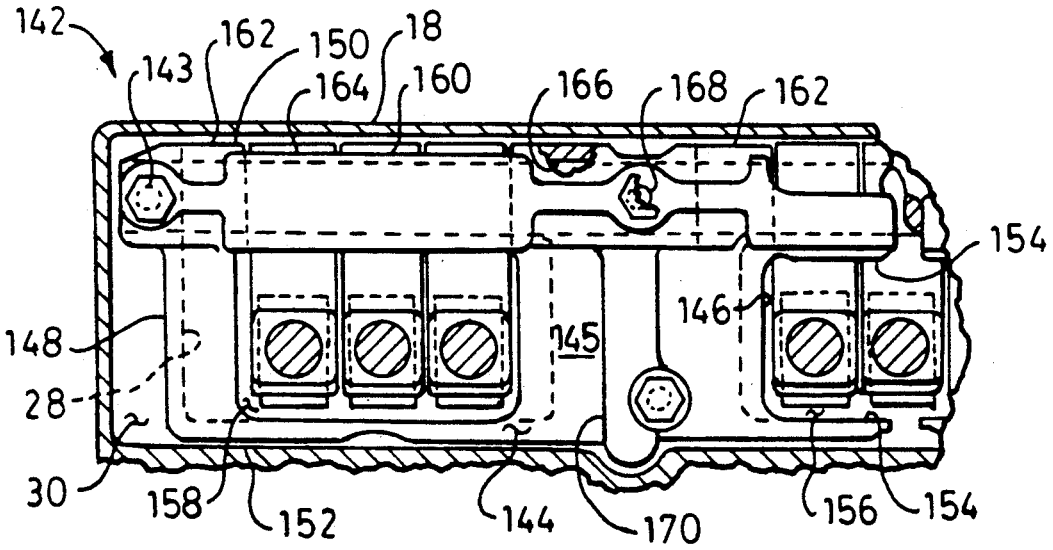
FIG. 3 is an enlarged sectional view of a portion of the retention shelf assemblies taken along line 3—3 of FIG. 2.

The cylinder head 16 includes a valve cover mounting surface 34 and a block mounting surface 36. The cylinder head 16 is attached to the block 14 by a plurality of bolts 38. The cylinder head 16 defines a plurality of openings 40 generally aligned with the plurality of openings 28. As an alternative, a single opening 40 can be defined by the cylinder head. Each of the plurality of openings 40 in the cylinder head extend between the valve cover mounting surface 34 and the block mounting surface 36. In this application, a plurality of rocker arm assemblies 44 are attached to the head 16 in a conventional arrangement. As an alternative, a single rocker arm assembly 44 could be used. In the specific example shown, an individual rocker arm assembly 44 is provided for each of the cylinders 24. Each of the rocker arm assemblies 44 includes at least one rocker arm 46 pivotally mounted on a shaft 48 and attached to the head 16 in a conventional manner. In the specific example illustrated, three rocker arm assemblies are provided for each cylinder of a six cylinder engine. Each of the rocker arms 46 has a first end 50 including a pin 52 having a spherical head 54 thereon and an actuation end 56. One of the rocker arms 46, as shown in FIG. 2, activates a unit fuel injector 60 in a conventional manner. A similar rocker arm 46 is used with each of a plurality of intake and exhaust valves 61,62. The injector 60 includes a body 63 having a bore therein, not shown, and a plunger 64 partially positioned in the bore. The plunger 64 has a flanged portion 66 at one end. A biasing means 80 is positioned between the body 63 and the flanged portion 66 of the injector 60. Thus, the biasing means 80 is positioned between the injector 60 and the actuation end 56 of the rocker arm 46. The biasing means 80 pivotally moves the first end 50 of the rocker arm 46 from a first operating position 82 wherein the unit fuel injector 60 is in the pumping position to a second operating position 84 wherein the unit injector 60 is in the filling position. A pushrod 94 has a spherical end 96 and a cupped end 98 having a contacting surface 100 normally in contact with the spherical head 54.

A means 110 for reciprocating each of the pushrods 94 and moving the first end 50 of the rocker arm 46 from the second operating position 84 to the first operating position 82 is positioned in the engine 12 and, as best shown in FIG. 2, is positioned at least partially within the opening 28. The means 110 includes a camshaft 112 rotatably positioned in the bore 26 of the block 14 and driven by a conventional mechanism, not shown. The camshaft 112 has a plurality of profile cam portions 114 thereon. The means 110 further includes a plurality of roller cam followers 116 of conventional design. Each of the roller cam followers 116 has a roller 118 attached thereto, a cupped portion 120 and a bore 122 therein. The reciprocating means 110 further includes a pair of shafts 124, of which only one is shown. Each of the shafts 124 has an axis X and a plurality of through bores 126 perpendicular to the axis X. Each of the shafts 124 are positioned in the bores 122 and rotatably support the plurality of the roller cam followers 116. Each of the roller cam followers 116 is interposed between the profile cam portion !14 of the camshaft 112 which is in contact with the roller 118 and the pushrod 94 which has the spherical end 96 in contact with the cupped portion 120 under normal operating conditions of the engine 12. In this application, a roller cam follower 116 is positioned on the shaft 124 for each of the intake valves 61, the exhaust valves 62 and the unit injectors 60.

Figure 4:
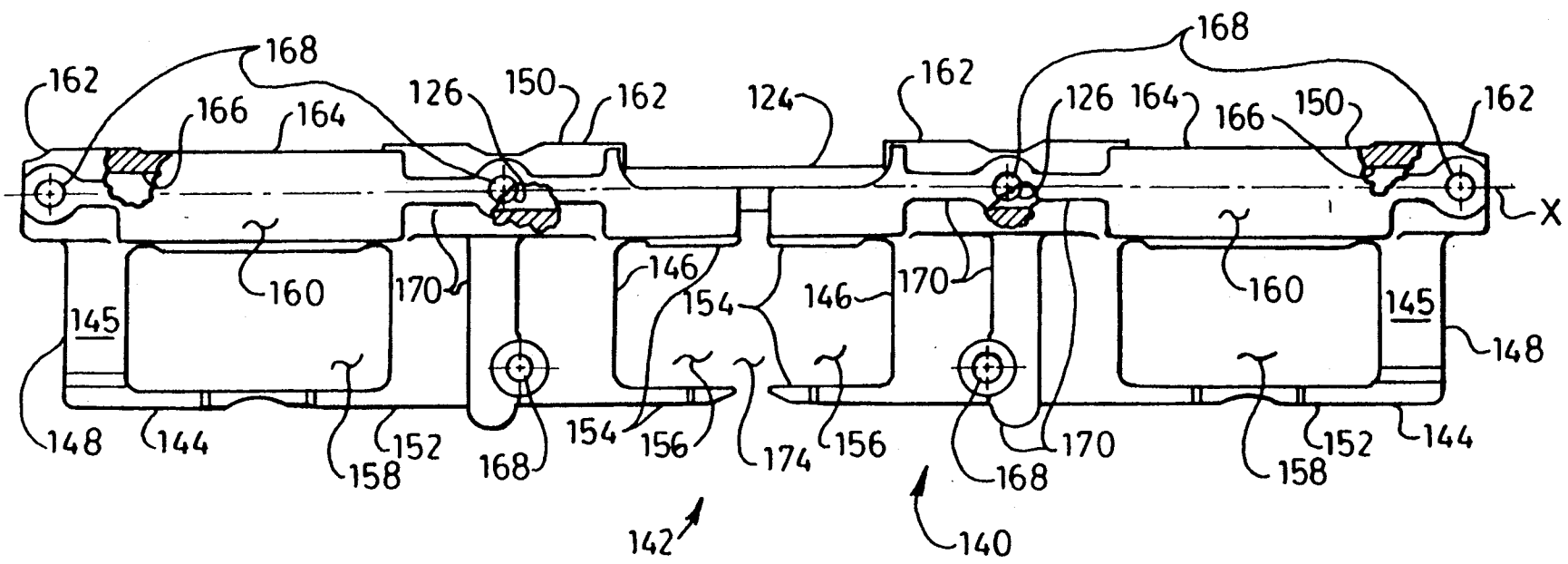
FIG. 4 is a top development view of a pair of the retention shelves having a shaft tieing the shelves together.

As best shown in FIG. 4, a means 140 for preventing any of the pushrods 94 from dropping into other components in the engine 12 is attached to the block 14 so that potential damage to the engine 12 is prevented or at least minimized should, for example, the biasing means 80 fail to move the first end 50 of the rocker arm 46 to the second operating position 84 and result in the individual pushrods 94 becoming loose or disconnected at either or both ends. In this specific application, the preventing means 140 includes a plurality of retention shelf assemblies 142 removably attached to the block by a plurality of mounting bolts 143. In this application, the plurality of retention shelf assemblies 142 includes four retention shelves 144 which make up two pair of shelf assemblies 142 when functionally assembled. Each shelf assembly 142 includes two retention shelves 144 which are mirror images of each other. As an alternative, a single retention shelf or a pair of retention shelves could be used. Each of the retention shelves 144 include a generally rectangular body 145, a first end 146, a second end 148, a first edge 150 and a second edge 152. A pair of arms 154 are attached to the rectangular body 145 at the first end 146 and extending therefrom forming a generally "U" shaped opening 156. A generally rectangular first opening 158 is positioned in the rectangular body 145 near the second end 148. Each of the rectangular bodies 145 further includes a generally "U" shaped support member 160 positioned at the first edge 150. The support member 160 includes a pair of bosses 162 positioned near each end and a bridge member 164 interconnecting each of the bosses 162. A through bore 166 having an axis axially extending through each of the bosses 162. The axis of the through bores 166 corresponds to the axis X of the shafts 124 when assembled together. A plurality of mounting holes 168 are positioned in the rectangular body 145. A portion of the plurality of mounting holes 168 are perpendicular to the axis X and intersect the through bore 166. In this particular application, each of the retention shelves 144 are aluminum die castings and include a plurality of ribs or reinforcing members 170. As an alternative, each of the retention shelves 144 could be made of a different material or as a fabrication. When assembled in functionally operating condition for use in the six cylinder engine 12, two retention shelf assemblies are used. Each of the retention shelf assemblies 142 include a pair of the retention shelves 144 with the "U" shaped openings 156 aligned next to each other forming a second generally rectangular opening 174.

INDUSTRIAL APPLICABILITY

In this specific example, the means 140 for preventing is used with a six cylinder engine 12 and includes a pair of the retention shelf assemblies 142. For example in this specific application, two of the retention shelves 144 are placed with the "U" shaped openings 156 end to end. Three of the roller cam followers 116 are positioned in each of the first rectangular openings 158 and in the second rectangular opening 174. One of the shafts 124 is positioned in the axially aligned bores 166, through the bores 122 in the roller cam followers 116 and aligned so that the mounting holes 168 are perpendicular to the axis X in the rectangular body 145 and are aligned with the plurality of through bores 126 in the shaft 124. A portion of the plurality of mounting bolts 143 are used to align the shaft 124 and the retention shelves 144 relative to each other and secure the pair of retention shelf assemblies 142 to the block 14. The remainder of the plurality of mounting bolts 143 secure the retention shelves 144 to the block 14.

During normal operation of the engine 12, the camshaft 112 rotates the profile cam 114 and causes the roller cam follower 116 to reciprocally move the pushrod 94 and rotates the rocker arm 46 resulting in the first end 50 of the the rocker arm 46 being moved to the first operating position 82 activating the unit injector 60. As the profile cam 114 continues to rotate, the force on the pushrod 94 is relieved and the biasing means 80 moves the first end 50 of the rocker arm 46 from the first operating position 82 to the second operating position 84. Thus, the engine 12 continues to operate normally with the pushrod 94 reciprocally positioned between the roller cam follower 116 and the rocker arm 46.

An example of a malfunction which could occur and cause the first end 50 of the rocker arm 46 to remain in the first operating position 82 would be if the injector 60 was to seize in the pumping position or with the rocker arm 46 in the first operating position 82. The operation of the engine 12 will be effected by this malfunction since the plunger 64 will not be able to fill. The camshaft 112 continues to rotate and causes the profile cam portion 114 to rotate resulting in the force on the pushrod 94 being relieved but the biasing means 80 does not have the capability of moving the seized injector 60 to the second operating position or filling position 84 resulting in the first end 50 of the rocker arm 46 not being moved to the second operating position 84. Thus, as the profile cam portion 114 continues to rotate, the roller 118 of the roller cam follower 116 will follow the contour of the profile cam portion 114 and the contacting surface 100 of the pushrod 94 will become free of contact with the spherical head 54 of the rocker arm 46 resulting in the pushrod 94 being free to float or become disengaged from the rocker arm 46 and/or the roller cam follower 116. The disengagement permits in the pushrod 94 to drop downwardly toward the plurality of openings 28 in the block 14. The pair of retention shelf assemblies 144 which are positioned on the mounting surfaces 30 above the openings 28 form a closure above the openings 28 and prevent the pushrod 94 which has become free from coming into contacting with the camshaft 112. The roller cam folloWers 116 Which extend within the rectangular first openings 158 and the rectangular second openings 174 in the retention shelves 144 are in close but non-contacting relationship to each other and to the retention shelves 144. Thus, this relationship of the roller cam followers 116 which are at least partially positioned in the first and second rectangular openings 158, 174 and substantially fill each of the openings 158, 174 and the retention shelves 144 further prevents or restricts the pushrod 94 which has become detached or free from damaging other components such as the camshaft 112 of the engine 12 or compressor.

Other aspects, objects and advantages of this invention can be obtained from a study of the drawings, the disclosure and the appended claims.

We claim:

1. An engine having a retention shelf, comprising:

a cylinder block having a longitudinally disposed through bore intermediate a top and bottom mounting surface and a plurality of openings therein extending at least partially between the top and bottom mounting surfaces, said plurality of openings being substantially in line and intersecting with the through bore in the block;

a cylinder head attached to the cylinder block;

a rocker arm pivotally mounted to the cylinder head and having a first end, said first end being movable between a first operating position and a second operating position;

means for biasing the first end of the rocker arm from the first operating position to the second operating position;

a pushrod being normally in contact with the first end of the rocker arm;

means for reciprocating the pushrod and moving the first end of the rocker arm from the second operating position to the first operating position, said reciprocating means being partially positioned in the openings in the cylinder block; and a retention shelf assembly in which potential damage to the engine, caused by the pushrod, can be prevented should said biasing means fail to move the first end of the rocker arm to the second operating position, said retention shelf assembly including at least one retention shelf assembly having a generally rectangular body and being positioned intermediate at least a portion of the means for reciprocating and the means for biasing and said retention shelf assembly at least partially filling the openings and being removably attached to the cylinder block.

2. The engine of claim 1, wherein said means for preventing includes a plurality of pairs of retention shelf assemblies.

3. The engine of claim 2, wherein said plurality of retention shelf assemblies are positioned above the through bore.

4. The engine of claim 1, wherein said retention shelf assembly includes a generally rectangular first opening, a pair of bosses positioned near each end of the opening, a generally rectangular second opening and a pair of axially aligned through bores in the bosses and said means for reciprocating including a shaft being positioned in the axially aligned through bores in the bosses and at least one roller cam follower having a bore therein, said roller cam follower being positioned on the shaft and extending into the rectangular first opening.

5. The engine of claim 4, wherein said shaft is fixedly attached to the retention shelf assembly and said roller cam follower is rotatably positioned on the shaft.

6. The engine of claim 4, further including a plurality of roller cam followers each having a bore therein, said roller cam followers being positioned on the shaft.

7. The engine of claim 6, wherein said plurality of roller cam followers substantially fill the first rectangular opening and the second rectangular opening in the retention shelf assemblies.

8. A retention shelf assembly adapted for use in an engine, said engine including a cylinder block having a longitudinally disposed through bore intermediate a top and bottom mounting surface and a plurality of openings therein extending at least partially between the top and bottom mounting surfaces, said plurality of openings being substantially in line and intersecting with the through bore in the block; a cylinder head attached to the cylinder block; a rocker arm pivotally mounted to the cylinder head and having a first end, said first end being movable between a first operating position and a second operating position; means for biasing the first end of the rocker arm from the first operating position to the second operating position; a pushrod being normally in contact with the first end of the rocker arm; means for reciprocating the pushrod and moving the first end of the rocker arm from the second operating position to the first operating position, said reciprocating means being partially positioned in the openings in the cylinder block, said retention shelf assembly comprising:

said retention shelf assembly adapted for use in the engine to prevent the pushrod from potentially damaging the engine should said biasing means fail to move the first end of the rocker arm to the second operating position when installed in the engine, said retention shelf assembly having a generally rectangular body and including at least one retention shelf assembly adapted to be positioned intermediate at least a portion of the means for reciprocating and the means for biasing and at least partially filling the openings and being removably attached to the cylinder block when installed.

9. The retention shelf assembly of claim 8, including a retention shelf having a generally rectangular body having a generally rectangular opening therein.

10. The retention shelf of claim 9, further including a first end and a pair of arms attached to the first end forming a generally "U" shaped opening.

11. The retention shelf assemblies of claim 10 wherein a pair of the retention shelves are positioned with the "U" shaped openings end to end and form a generally rectangular second opening therebetween.

12. The retention shelf assemblies of claim 11, wherein each of the pair of retention shelves further includes a support member, said support member including a pair of bosses, each of said bosses including a through bore extending therethrough and each of said through bores in the bosses being axially aligned with each other.

13. The retention shelf assemblies of claim 12, wherein said means for reciprocating includes a pair of shafts and a plurality of roller cam followers each having a bore therein, one of said pair of shafts being positioned in the through bores in the bosses and being rotatably positioned in each of the bores of each of the plurality of roller cam followers.

14. The retention shelf assemblies of claim 13, wherein said roller cam followers substantially fill the rectangular opening in each of the shelf member.

15. An engine having a retention shelf, comprising:

a cylinder block having a longitudinally disposed through bore intermediate a top mounting surface and a bottom mounting surface and a plurality of openings therein extending at least partially between the top and bottom mounting surfaces, said plurality of openings being substantially in line and intersecting with the through bore in the block;

a cylinder head attached to the cylinder block;

a rocker arm pivotally mounted to the cylinder head and having a first end, said first end being movable between a first operating position and a second operating position;

means for biasing the first end of the rocker arm from the first operating position to the second operating position;

a pushrod being normally in contact with the first end of the rocker arm;

means for reciprocating the pushrod and moving the first end of the rocker arm from the second operating position to the first operating position, said reciprocating means being partially positioned in the openings in the cylinder block; and a retention shelf assembly in which potential damage to the engine, caused by the pushrod, can be prevented should said biasing means fail to move the first end of the rocker arm to the second operating position, said retention shelf assembly including a pair of retention shelf assemblies positioned intermediate at least a portion of the means for reciprocating and the means for biasing and at least partially filling the openings and being removably attached to the cylinder block.

16. The engine of claim 15, wherein each pair of said plurality of retention shelf assemblies include a generally rectangular first opening, a pair of bosses positioned near each end of the opening, a generally rectangular second opening and an axially aligned through bore in the bosses and said means for reciprocating including a shaft being positioned in the axially aligned through bores in the bosses and at least one roller cam follower having a bore therein, said roller cam follower being positioned on the shaft and extents into the rectangular openings.

17. The engine of claim 16, wherein said shaft is fixedly attached to the retention shelf assembly and said roller cam follower is rotatably positioned on the shaft.

18. The engine of claim 16, further including a plurality of roller cam followers each having a bore therein, said roller cam followers being positioned on the shaft.

19. The engine of claim 18, wherein said plurality of roller cam followers substantially fill the first rectangular opening and the second rectangular opening in the retention shelf assemblies.

* * * * *